US008540828B2

(12) United States Patent
Busky et al.

(10) Patent No.: US 8,540,828 B2
(45) **Date of Patent: *Sep. 24, 2013**

(54) NONTOXIC, NONCORROSIVE PHOSPHORUS-BASED PRIMER COMPOSITIONS AND AN ORDNANCE ELEMENT INCLUDING THE SAME

(75) Inventors: Randall T. Busky, Independence, MO (US); Tod R. Botcher, Canyon, TX (US); Joel L. Sandstrom, Rogers, MN (US); Jack A. Erickson, Andover, MN (US)

(73) Assignee: Alliant Techsystems Inc., Arlington, VA (US)

( * ) Notice: Subject to any disclaimer, the term of this patent is extended or adjusted under 35 U.S.C. 154(b) by 1413 days.

This patent is subject to a terminal disclaimer.

(21) Appl. No.: 12/194,437

(22) Filed: Aug. 19, 2008

(65) Prior Publication Data

US 2012/0132099 A1 May 31, 2012

(51) Int. Cl.

| | |
|---|---|
| ***C06B 45/00*** | (2006.01) |
| ***C06B 45/18*** | (2006.01) |
| ***C06B 29/00*** | (2006.01) |
| ***D03D 23/00*** | (2006.01) |
| ***D03D 43/00*** | (2006.01) |

(52) U.S. Cl.
USPC ..... 149/3; 149/2; 149/29; 149/108.8; 149/109.4

(58) Field of Classification Search
USPC ..... 149/29, 87, 2, 3, 108.2, 109.4
See application file for complete search history.

(56) References Cited

U.S. PATENT DOCUMENTS

| | | | |
|---|---|---|---|
| 998,007 | A | 7/1911 | Imperiali |
| 2,194,480 | A | 3/1940 | Pritham et al. |
| 2,206,048 | A | 7/1940 | Rechel et al. |
| 2,231,946 | A | 2/1941 | Rechel et al. |
| 2,349,048 | A | 5/1944 | Mackey et al. |
| 2,420,651 | A | 5/1947 | Burrows et al. |
| 2,649,047 | A | 8/1953 | Silverstein |

(Continued)

FOREIGN PATENT DOCUMENTS

| | | | |
|---|---|---|---|
| DE | 2513735 | A1 | 10/1975 |
| DE | 19606237 | A1 | 8/1996 |

(Continued)

OTHER PUBLICATIONS

Alenfelt, Corrosion Protection of Magnesium Without the Use of Chromates, Pyrotechnica XVI (Aug. 1995) pp. 44-49, Pyrotechnica Pulbications, Austin TX.

(Continued)

*Primary Examiner* — James McDonough
(74) *Attorney, Agent, or Firm* — TraskBritt

(57) ABSTRACT

A primer composition that includes red phosphorus having an acid scavenger and a polymer thereon. The primer composition includes at least one other component that is substantially free of lead. The other component is at least one oxidizer, or at least one oxidizer and at least one of at least one secondary explosive composition and at least one energetic binder. The primer composition optionally includes at least one element having an ionic charge to ionic radius ratio of 4 or of 8, such as magnesium, zirconium, aluminum, silicon, titanium, tungsten, alloys thereof, and combinations thereof. The red phosphorus and the at least one oxidizer are present in the primer composition at approximately stoichiometric amounts. An ordnance element including the primer composition is also disclosed.

25 Claims, 5 Drawing Sheets

(56) References Cited

U.S. PATENT DOCUMENTS

| | | | | |
|---|---|---|---|---|
| 2,664,344 | A * | 12/1953 | Nordblom et al. | 423/322 |
| 2,929,699 | A | 3/1960 | Audrieth et al. | |
| 2,970,900 | A * | 2/1961 | Woodring et al. | 149/6 |
| 3,026,221 | A | 3/1962 | Kirst et al. | |
| 3,113,059 | A | 12/1963 | Ursenbach et al. | |
| 3,187,671 | A * | 6/1965 | Quinlan et al. | 102/470 |
| 3,367,805 | A | 2/1968 | Clay et al. | |
| 3,437,534 | A | 4/1969 | McEwan et al. | |
| 3,488,711 | A | 1/1970 | Dany et al. | |
| 3,540,819 | A | 11/1970 | Brown | |
| 3,634,153 | A | 1/1972 | Perkins et al. | |
| 3,650,856 | A | 3/1972 | Artz | |
| 3,707,411 | A | 12/1972 | Furth et al. | |
| 3,726,217 | A | 4/1973 | Dedman et al. | |
| 3,755,019 | A | 8/1973 | Huskins et al. | |
| 3,767,488 | A | 10/1973 | Seals | |
| 3,834,956 | A | 9/1974 | Mellow et al. | |
| 3,904,451 | A | 9/1975 | Rainone | |
| 4,014,719 | A | 3/1977 | Wells | |
| 4,059,388 | A | 11/1977 | Shaffer | |
| 4,133,707 | A | 1/1979 | Andrew | |
| 4,142,927 | A | 3/1979 | Walker et al. | |
| 4,145,969 | A | 3/1979 | Gawlicke et al. | |
| 4,196,026 | A | 4/1980 | Walker et al. | |
| 4,226,792 | A | 10/1980 | Tajima | |
| 4,304,614 | A | 12/1981 | Walker et al. | |
| 4,315,897 | A | 2/1982 | Staendeke et al. | |
| 4,336,085 | A | 6/1982 | Walker et al. | |
| 4,522,665 | A | 6/1985 | Yates, Jr. et al. | |
| 4,554,031 | A | 11/1985 | Kerviel et al. | |
| 4,581,082 | A | 4/1986 | Hagel et al. | |
| 4,698,215 | A | 10/1987 | Albanesi et al. | |
| 4,728,375 | A | 3/1988 | Simpson | |
| 4,853,288 | A | 8/1989 | Staendeke et al. | |
| 4,963,201 | A | 10/1990 | Bjerke et al. | |
| 4,976,793 | A | 12/1990 | Zimmermann | |
| 5,167,736 | A | 12/1992 | Mei et al. | |
| 5,208,420 | A | 5/1993 | Hamilton et al. | |
| 5,216,199 | A | 6/1993 | Bjerke et al. | |
| 5,316,600 | A | 5/1994 | Chan et al. | |
| 5,388,519 | A | 2/1995 | Guindon et al. | |
| 5,417,160 | A | 5/1995 | Mei et al. | |
| 5,522,320 | A | 6/1996 | Dillehay | |
| 5,547,528 | A | 8/1996 | Erickson et al. | |
| 5,567,252 | A | 10/1996 | Mei et al. | |
| 5,717,159 | A | 2/1998 | Dixon et al. | |
| 5,780,768 | A | 7/1998 | Knowlton et al. | |
| 5,831,208 | A | 11/1998 | Erickson | |
| 5,992,327 | A | 11/1999 | Wardecki et al. | |
| 6,053,108 | A | 4/2000 | Remerowski | |
| 6,057,264 | A | 5/2000 | Bradbury | |
| 6,322,648 | B2 | 11/2001 | Rayer et al. | |
| 6,478,903 | B1 | 11/2002 | John, Jr. et al. | |
| 6,544,363 | B1 | 4/2003 | Erickson | |
| 6,581,520 | B1 | 6/2003 | Koch et al. | |
| 6,612,242 | B2 | 9/2003 | Raupp et al. | |
| 6,645,625 | B2 | 11/2003 | Horold et al. | |
| 6,663,731 | B1 | 12/2003 | Rose et al. | |
| 6,782,827 | B2 | 8/2004 | Miskelly, Jr. | |
| 6,878,221 | B1 * | 4/2005 | Mei et al. | 149/41 |
| 7,129,348 | B1 | 10/2006 | Wardle et al. | |
| 7,192,649 | B1 | 3/2007 | Jouet et al. | |
| 7,857,921 | B2 * | 12/2010 | Busky et al. | 149/30 |
| 8,202,377 | B2 * | 6/2012 | Erickson et al. | 149/109.6 |
| 2002/0007885 | A1 | 1/2002 | Serizawa et al. | |
| 2002/0127403 | A1 | 9/2002 | Horold et al. | |
| 2005/0183805 | A1 | 8/2005 | Pile et al. | |
| 2005/0189053 | A1 | 9/2005 | Pile et al. | |
| 2005/0224147 | A1 | 10/2005 | Jung et al. | |
| 2006/0060273 | A1 | 3/2006 | Smith | |
| 2006/0113014 | A1 | 6/2006 | Puszynski et al. | |
| 2006/0219341 | A1 | 10/2006 | Johnston et al. | |
| 2006/0272756 | A1 | 12/2006 | Kneisl et al. | |
| 2007/0017612 | A1 * | 1/2007 | Hagel et al. | 149/38 |
| 2008/0110365 | A1 | 5/2008 | Rastegar et al. | |
| 2009/0139618 | A1 * | 6/2009 | Petrie et al. | 149/19.1 |
| 2010/0032063 | A1 | 2/2010 | Mei et al. | |

FOREIGN PATENT DOCUMENTS

| | | | |
|---|---|---|---|
| DE | 10138745 | | 9/2010 |
| EP | 0283759 | B1 | 7/1990 |
| EP | 0334725 | B1 | 2/1993 |
| EP | 0560583 | | 9/1993 |
| EP | 0699646 | B1 | 3/1996 |
| EP | 0952130 | A1 | 10/1999 |
| EP | 1195366 | A3 | 7/2003 |
| EP | 0911366 | B1 | 3/2004 |
| EP | 0737174 | B1 | 9/2004 |
| WO | 9515298 | | 6/1995 |
| WO | 9612770 | | 5/1996 |
| WO | 9944968 | | 9/1999 |
| WO | 0206421 | | 1/2002 |
| WO | 2006009579 | A2 | 1/2006 |
| WO | 2006009579 | A3 | 1/2006 |
| WO | 2006083379 | A2 | 8/2006 |

OTHER PUBLICATIONS

Muller, Citric Acid as Corrosion Inhibitor for Aluminium Pigment, Corrosion Science, Abstract, vol. 46, No. 1, Jan. 2004, pp. 159-167.

Ostrowski et al., AL/Mo03 MIC Primer Evaluation Tests Part II: Delay Cartridges, American Institute of Aeronautics and Astronautics, AIAA/ASME/SAE/ASEE Joint Propulsion Conference, Huntsville, AL. 2000 Paper 2000-3647.

Ostrowski et al., Recent Accomplishments in MIC Primer Development at NSWC/Indian Head, Paper 2005-3514, AIAA 41st Joint Propulsion Conference, Tucson, AZ, 2005.

Ostrowski et al., Nano Energetics for US Navy Percussion Primer Applications, Energetic Materials Technology, 2006, pp. 1-6.

Busky, Randall, et al., "Non-toxic Heavy Metal Free Primers for Small Arms Cartridges—Red Phosphorous Based," presented May 8, 2007.

Collins, et al; "The Use of Red Phosphorous in Pyrotechnics—Results of an International Investigation"; 31st International Pyrotechnic Seminar Proceedings, Jul. 2004, Colorado Springs, Colorado, Copyright © 2002, IPSUSA.

Eisentrager, Frank; "Key Parameters for the Stability of Red Phosphorous"; 31st International Pyrotechnic Seminar Proceedings, Jul. 2004, Colorado Springs, Colorado, Copyright 2000 © IPSUSA.

European Search Report for European Application No. EP 07 00 4155, dated Jul. 16, 2007.

Horold, Sebastian and Ratcliff, A.; Commercial Developments in Red Phosphorous Performance and Stablity for Pyrotechnics; Journal of Pyrotechnics, Issue 12, Summer 2001 Copyright © 2001 IPS.

Horold, Sebastian; "Improvements in Stability of Red Phosphorous", 27th International Pyrotechnic Seminar Proceedings, Jul. 2000, Grand Junction Colorado, Copyright © 2000 IPSUSA.

Levitas, Valery I., et al., "Mechanochemical mechanism for fast reaction of metastable intermolecular composites based on dispersion of liquid metal," J. Appl. Phys., vol. 101, pp. 083524-1 through 083524-20, 2007.

Nordblom, et al., Frankfort Arsenal Report No. R-206; the Stabilization of Commercial Red Phosphorus Final Report, Research Item No. 202.14, Frankford Arsenal Library, Apr. 1943.

Railsback, L. Bruce, "An earth scientist's periodic table of the elements and their ions," Geology, pp. 737-740, Sep. 2003.

Railsback, L. Bruce, "An earth scientist's periodic table of the elements and their ions," Version 4.8, University of Georgia, Athens, Georgia, © 2007, http://www.gly.uga.edu/railsback/PT.html.

Ratcliff, Andrew; "Review of Six Generations of Red Phosphorous 1950-1999 and Beyond", 27th International Pyrotechnic Seminar Proceedings, Jul. 2000, Grand Junction Colorado, Copyright 2000 © IPSUSA.

Rovner, Sophie, "How a Lubricant Additive Works," Chemical & Engineering News, vol. 83, No. 11., p. 10, © 2005.

Stevenson, et al., Frankford Arsenal Report No. R-265; Caliber .30 Red Phosphorus Primers, Third Report Research Item No. 204.0, Frankfort Arsenal Library, Feb. 1943.
United States Army, Small Caliber Ammunition Test Procedures 5.56mm Cartridges, Picatinny Aresenal, New Jersey, Nov. 1998, pp. 1-191.
Provatas, Arthur, Energetic Polymers and Plasticisers for Explosive Formulations—A review of Recent Advances, Weapons Systems Division Aeronautical and Maritime Research Laboratory, Apr. 2000, 44 pages.
Definition of "composition," Hackh's Chemical Dictionary, 4th Ed., Copyright 1969 by McGraw-Hill, Inc., New York, NY.
Definition of "mixture," The American Heritage College Dictionary, 3rd Ed., Copyright 2000 by Houghton Mifflin Company, Boston, MA.
U.S. Appl. No. 11/367,000, filed Mar. 2, 2006, by Randall T. Busky et al., entitled "Nontoxic, Noncorrosive Phosphorus-Based Primer Composition, a Percussion Cap Primer Comprising the Same and Ordnance Including the Same."
PCT International Search Report and Written Opinion of the International Searching Authority for PCT/US2012/047181, dated Jan. 31, 2013, 8 pages.

* cited by examiner

NONTOXIC, NONCORROSIVE PHOSPHORUS-BASED PRIMER COMPOSITIONS AND AN ORDNANCE ELEMENT INCLUDING THE SAME

CROSS-REFERENCE TO RELATED APPLICATION

The present application is related to U.S. patent application Ser. No. 11/367,000 entitled NON-TOXIC, NONCORROSIVE PHOSPHORUS-BASED PRIMER, filed Mar. 2, 2006, now U.S. Pat. No. 7,857,921, issued Dec. 28, 2010, which is assigned to the Assignee of the present application.

TECHNICAL FIELD

Embodiments of the present invention relate to nontoxic, noncorrosive primer compositions. More specifically, the present invention relates to a primer composition that includes red phosphorus and at least one other component, such as at least one oxidizer and at least one of a binder(s) and a secondary explosive composition(s). A fuel may, optionally, be present.

BACKGROUND

A primer composition is a primary explosive composition that is used to initiate or ignite another explosive composition, propellant, or charge. This other explosive composition, propellant, or charge is referred to herein as a so-called "main" explosive composition. The primer composition is more sensitive to impact and friction than the main explosive composition. The main explosive composition is relatively stable and does not ignite until initiated by the primer composition.

Many ingredients of conventional primer compositions are chronically toxic and their use is regulated by the Environmental Protection Agency. These ingredients include styphnate and picrate salts, heavy metal compounds, or diazodinitrophenol ("DDNP" or dinol). The regulated metal compounds include compounds of mercury, lead, barium, antimony, beryllium, cesium, cadmium, arsenic, chromium, selenium, strontium, or thallium. When combusted, a primer composition that includes one of these ingredients emits toxic lead oxides or toxic compounds of other heavy metals, such as oxides of cesium, barium, antimony, or strontium. DDNP is also hazardous because it is known to cause allergic reactions and is possibly carcinogenic, as identified by The Centers for Disease Control and Prevention/Agency for Toxic Substances and Disease Registry ("CDC"). Some combustion products are gaseous and are inhaled by a user of ordnance when used in applications such as small caliber ammunition that includes the primer composition. Other gaseous combustion products are typically in the form of dust or oxides of the toxic compounds mentioned above. Since small caliber ammunition is fired in large quantities in indoor and outdoor ranges for training or practice, as well as for hunting, sporting events (trap shooting, biathlon, etc.) and military simulations, the user of small caliber ammunition is potentially exposed to large amounts of these toxic combustion products.

To reduce health and environmental risks, primer compositions that are free of lead have been developed. U.S. Pat. No. 4,522,665 to Yates, Jr. et al. discloses a percussion primer that includes titanium and potassium perchlorate. U.S. Pat. No. 5,417,160 to Mei et al. discloses a percussion primer that contains calcium silicide, DDNP, and an alkaline or alkaline earth nitrate. U.S. Pat. No. 5,167,736 to Mei et al. discloses a percussion primer that includes DDNP and boron and U.S. Pat. No. 5,567,252 to Mei et al. discloses a percussion primer that includes DDNP, boron, and iron oxide. U.S. Pat. Nos. 4,963,201 and 5,216,199 to Bjerke et al. disclose a percussion primer that includes DDNP, strontium nitrate, tetracene, and a nitrate ester fuel. U.S. Pat. No. 6,478,903 to John, Jr. et al. discloses a percussion primer that includes bismuth sulfide and potassium nitrate or zinc sulfide and aluminum nitrate. U.S. Pat. No. 4,581,082 to Hagel et al. discloses a primer charge that includes zinc peroxide, DDNP, and/or a strontium salt of mono- and/or dinitrodihydroxydiazobenzene. U.S. Pat. No. 5,831,208 to Erickson discloses a lead-free, center-fire primer that includes barium nitrate, a primary explosive, a sensitizer, a nitrated ester, an abrasive sensitizer, a fuel, and a binder.

Red phosphorus has also been used in primer compositions. Red phosphorus is an allotrope of phosphorus that has a network of tetrahedrally arranged groups of four phosphorus atoms linked into chains. White phosphorous is another allotrope that is much more reactive and toxic than red phosphorous. Red phosphorus-based primer compositions were determined to be unsatisfactory by the U.S. Army Ordnance Department due to the chemical instability of the red phosphorus, which produced corrosive by-products capable of corroding metal components. U.S. Pat. No. 2,970,900 to Woodring et al. discloses a purportedly noncorrosive, priming composition that includes red phosphorus, a secondary explosive, and an oxidizing agent. The red phosphorus is stabilized by treatment with acid, elutriation, and coating with aluminum hydroxide. The secondary explosive is pentaerythritol tetranitrate ("PETN"), trimethylenetrinitramine, trinitrotoluene ("TNT"), or combinations thereof. The oxidizing agent is barium nitrate, potassium nitrate, lead nitrate, lead dioxide, basic lead nitrate, or a barium nitrate-potassium nitrate double salt. U.S. Pat. No. 2,194,480 to Pritham et al. discloses a purportedly noncorrosive, priming composition that includes red phosphorus, a fuel, such as zirconium, and an oxidizer, such as barium nitrate, strontium nitrate, basic lead nitrate, lead peroxide, or antimony sulfide. U.S. Pat. No. 2,649,047 to Silverstein discloses a primer that includes a primer composition and a metal cup. The primer composition includes red phosphorus and barium nitrate. The metal cup is formed from a metal or coated with a metal that is less catalytically active than nickel, such as aluminum, aluminum alloys, zinc, chromium, cadmium, lead, tin, lead/tin alloys, or Duralumin. U.S. Pat. No. 2,231,946 to Rechel et al. discloses a propellant powder that includes a small amount of red phosphorus, which inhibits erosion of the gun barrel.

Red phosphorus-based compositions have also been used as smoke-producing or obscurant compositions. These compositions typically include an excess amount of red phosphorus relative to oxidizing agent and utilize oxygen in the atmosphere to enhance the production of smoke. Upon ignition, these red phosphorus-based compositions provide low amounts of heat, sufficient to cause the red phosphorus to smolder, producing aerosol particles and dense smoke.

Red phosphorus is relatively stable in air and is easier to handle than other allotropes of phosphorus. However, if red phosphorus is exposed to oxygen ("$O_2$"), water ("$H_2O$"), or mixtures thereof at elevated temperatures, such as during storage, the red phosphorus reacts with the $O_2$ and $H_2O$, releasing phosphine ("$PH_3$") gas and phosphoric acids ($H_3PO_2$, $H_3PO_3$, or $H_3PO_4$). As is well known, the $PH_3$ is toxic and the phosphoric acids are corrosive. To improve the stability of red phosphorus in environments rich in $O_2$ or $H_2O$, dust suppressing agents, stabilizers, or microencapsulating resins have been used. The dust suppressing agents are liquid organic compounds. The stabilizers are typically inorganic salts, such as metal oxides. The microencapsulating resins are thermoset resins, such as epoxy resins or phenolic resins. Currently, microencapsulating resins are not used in military phosphorus applications. The military specification for phosphorous has been deactivated and is not expected to be updated to include encapsulation.

Red phosphorus has also been used as a flame retardant in a polymer-based composition, as disclosed in U.S. Pat. No. 4,698,215 to Albanesi et al. The red phosphorus is stabilized by coating particles of the red phosphorus with a first layer of aluminum hydroxide and a second layer of a urea-melamine-phenol-formaldehyde resin. Red phosphorus has also been used in a pyrotechnic composition to block infrared radiation and visible light, as disclosed in U.S. Pat. No. 4,728,375 to Simpson. The red phosphorus is stabilized by dispersing the red phosphorus in a rubber.

BRIEF SUMMARY

An embodiment of the present invention relates to a primer composition that includes red phosphorus stabilized with an acid scavenger and a polymer, and at least one component substantially free of lead.

Another embodiment of the present invention relates to a primer composition that includes red phosphorus stabilized with an acid scavenger and a polymer, and at least one oxidizer.

Another embodiment of the present invention relates to a primer composition including red phosphorus, at least one oxidizer, and at least one of at least one secondary explosive composition and at least one energetic binder. The red phosphorus has a metal oxide and a polymer formed thereon.

Another embodiment of the present invention relates to a primer composition that consists of red phosphorus coated with a metal oxide and a polymer, potassium nitrate, a metal material including at least one of magnesium, zirconium, aluminum, silicon, titanium, tungsten, and alloys thereof, and at least one of pentaerythritol tetranitrate and gum tragacanth.

Another embodiment of the present invention relates to an ordnance element including one of the primer compositions described above.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION

Figure 1:
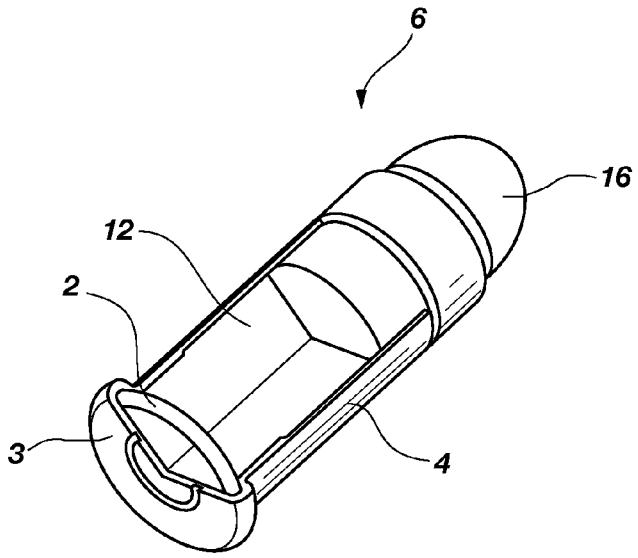
FIG. 1 is a cross-sectional view of a rimfire gun cartridge.

An explosive composition for use as a primer composition is disclosed. The primer composition may initiate or detonate upon impact, heat (spark or flame), friction, slight percussion, such as shock waves, or combinations thereof. Upon initiation, the primer composition generates heat, gases, and condensing hot particles that are of sufficient energy to ignite a main explosive composition in an ordnance element, such term including any device including at least one of an explosive or propellant, including structures configured with warheads or other projectiles. As such, the primer composition may be the first explosive composition ignited in an ignition train of the ordnance element. The primer composition may include ingredients that are low in toxicity, free of heavy metals, stable to aging, and noncorrosive. These ingredients may include elements that are biologically available, have a high concentration tolerance, and are active in known cycles in the environment or biosphere. For the sake of example only, these elements may include, but are not limited to, carbon, hydrogen, nitrogen, oxygen, potassium, sodium, calcium, phosphorus, magnesium, aluminum, and tin. When combusted, the primer composition may generate nontoxic and noncorrosive combustion products and by-products. The primer composition may also be highly reliable in that it reliably ignites the main explosive composition.

The primer composition includes red phosphorus and at least one other component, such as at least one oxidizer. The at least one other component may be substantially free of lead so that the primer composition is substantially free of lead. As used herein, the phrase "substantially free of lead" means and includes a composition including lead at less than approximately 2% by weight ("wt %") of a total weight of the primer composition, such as trace or impurity levels of lead. The primer composition may also include at least one energetic binder, at least one secondary explosive composition, or a combination of at least one energetic binder and at least one secondary explosive composition. The primer composition may, optionally, include at least one fuel. Relative amounts of these components may be adjusted to achieve desired properties of the primer composition upon combustion. As described in detail herein, the red phosphorus may be stabilized, encapsulated red phosphorus. The stabilized, encapsulated red phosphorus may have improved stability to oxidation relative to red phosphorus lacking stabilization and encapsulation. When the stabilized, encapsulated red phosphorus is exposed to an environment that includes $O_2$, $H_2O$, or combinations thereof, the stabilized, encapsulated red phosphorus does not readily react with the $O_2$ or $H_2O$, in contrast to red phosphorus that lacks stabilization and encapsulation.

The primer composition including the stabilized, encapsulated red phosphorus may have an increased useful lifetime or shelf life compared to a primer composition including red phosphorus that lacks stabilization and encapsulation. As used herein for convenience and clarity, the term "stabilized, encapsulated red phosphorus" means and includes red phosphorus stabilized by both an acid scavenger and a polymer, which are described in detail below. While the term "stabilized, encapsulated red phosphorus" is used herein, the acid scavenger and the polymer may, in actuality, form a discontinuous coating on the red phosphorus, as described in detail below.

The red phosphorus used in the primer composition may be in the form of a powder, particles, or other suitable configuration. The average particle size of the red phosphorus may be less than approximately 400 μm, such as from approximately 10 μm to approximately 100 μm. The red phosphorus may be stabilized by applying the acid scavenger, or a buffer, to the red phosphorus. The acid scavenger may absorb, adsorb, or neutralize acid species that are produced upon oxidation of the red phosphorus. The acid scavenger may be a metal oxide, such as a metal hydroxide, a hydrotalcite, a zeolite, a metal soap, or a metal carbonate. In one embodiment, the acid scavenger is a metal oxide that is precipitated on a surface of the red phosphorus, forming a coating thereon. The metal oxide coating on the red phosphorus may be substantially continuous or may be discontinuous. The metal oxide functions as a stabilizer to buffer acidic species produced by oxidation of the red phosphorus. The metal oxide may be aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, or combinations thereof. The metal oxide may be present in the stabilized, encapsulated red phosphorus in a total quantity that ranges from approximately 0.1 wt % to approximately 2 wt % based on the quantity of red phosphorus. The metal oxide may be formed on the red phosphorus by mixing an aqueous suspension of the red phosphorus with a water-soluble metal salt. The water-soluble metal salt may be selected depending on the metal oxide to be used. The pH of the aqueous suspension may be adjusted, causing the metal oxide to precipitate onto the red phosphorus and form the coating thereon.

A polymer, such as a thermoset resin, may be applied to the stabilized red phosphorus (stabilized by the acid scavenger, such as the metal oxide), forming a coating thereon. The polymer coating on the red phosphorus may be substantially continuous or may be discontinuous. Applying the polymer to the stabilized red phosphorus reduces its active surface and provides the stabilized red phosphorus with water repellancy and acid resistance. Polymers that may be used include, but are not limited to, an epoxy resin, melamine resin, phenol formaldehyde resin, polyurethane resin, or combinations thereof. The polymer may be present in the stabilized, encapsulated red phosphorus in a total quantity that ranges from approximately 1 wt % to approximately 5 wt % based on the quantity of red phosphorus. To apply the polymer to the stabilized red phosphorus, an aqueous solution of a preliminary condensation product of the polymer may be prepared and added, with mixing, to the stabilized red phosphorus. The solution and the stabilized red phosphorus may be reacted for a period of time that ranges from approximately 0.5 hour to approximately 3 hours at a temperature ranging from approximately 40° C. to approximately 100° C., enabling the preliminary condensation product to polymerize and harden, forming the polymer coating on the stabilized red phosphorus. The resulting coating on the red phosphorus, which includes both the acid scavenger and the polymer, may be substantially continuous or may be discontinuous. The stabilized, encapsulated red phosphorus may also be formed by applying the polymer coating to the red phosphorus, followed by applying the acid scavenger coating.

The stabilized, encapsulated red phosphorus may then be filtered and dried at an elevated temperature, such as at a temperature ranging from approximately 80° C. to approximately 120° C., in a stream of nitrogen. The metal oxide and the polymer may be present in a total quantity of from approximately 1.1 wt % to approximately 8 wt % based on the quantity of red phosphorus. The stabilized, encapsulated red phosphorus may be present in a range of from approximately 10 wt % of a total weight of the primer composition to approximately 30 wt % of the total weight of the primer composition.

Alternatively, the stabilized, encapsulated red phosphorus may be obtained commercially. Stabilized, encapsulated red phosphorus is commercially available, such as from Clariant GmbH (Frankfurt, Germany) or from Italmatch Chemicals (Genova, Italy). In one embodiment, the stabilized, encapsulated red phosphorus is Red Phosphorus HB 801 (TP), which is available from Clariant GmbH.

While primer compositions including stabilized, encapsulated red phosphorus are described herein, encapsulated red phosphorus may be used in the primer composition if a long lifetime or shelf life is not a critical property of the primer composition. As used herein, the term "encapsulated red phosphorus" means and includes red phosphorus having the polymer coating, but lacking the acid scavenger coating. The primer composition including the encapsulated red phosphorus may have an increased useful lifetime or shelf life compared to a primer composition including red phosphorus that lacks stabilization and encapsulation. However, the primer composition including the encapsulated red phosphorus may have a shorter shelf life than a primer composition including the stabilized, encapsulated red phosphorus. The former primer composition may be advantageous depending on the intended use of the primer composition. The encapsulated red phosphorus may be formed by applying the polymer to the red phosphorus. The polymer coating may be formed on the red phosphorus in a similar method to that described above, except that the polymer coating is formed on the red phosphorus rather than on the coating of the acid scavenger.

The oxidizer used in the primer composition may be a light metal nitrate. As used herein, the term "light metal nitrate" refers to a nitrated compound of an alkali or alkali earth metal (from Group I or Group II of the Periodic Table of the Elements) having an atomic mass of less than or equal to approximately 133. The oxidizer may include, but is not limited to, lithium nitrate, beryllium nitrate, sodium nitrate, magnesium nitrate, potassium nitrate, calcium nitrate, rubidium nitrate, strontium nitrate, cesium nitrate, or combinations thereof. If potassium nitrate is used as the oxidizer, the potassium nitrate may be stabilized, such as by encapsulating the potassium nitrate. By way of non-limiting example, the potassium nitrate may be stabilized by a coating of a nitrocellulose lacquer. Alternatively, the oxidizer may be bismuth subnitrate, $Bi_5O(OH)_9(NO_3)_4$, or a combination of bismuth subnitrate and at least one of the above-referenced light metal nitrates. In one embodiment, the oxidizer is sodium nitrate, potassium nitrate, calcium nitrate, or combinations thereof. The oxidizer may be present in the primer composition at a range of from approximately 30 wt % of the total weight of the primer composition to approximately 80 wt % of the total weight of the primer composition.

At least one of a secondary explosive composition and an energetic binder may be present in the primer composition. As used herein, the term "secondary explosive composition" means and includes an explosive composition that initiates or detonates upon slight percussion, such as supersonic shock waves. The secondary explosive composition provides insensitive physical ignition properties to the primer composition. The secondary explosive composition may be a compound or a mixture of compounds that includes carbon, hydrogen, nitrogen, and oxygen. Examples of secondary explosive compositions that may be used include, but are not limited to, PETN, cyclo-1,3,5-trimethylene-2,4,6-trinitramine (RDX), cyclotetramethylene tetranitramine (HMX), TNT, or combinations thereof. In addition, insensitive nitramine or nitroaromatic compounds may be used, such as CL-20, compounds with properties similar to those of CL-20, or combinations thereof. If present, the secondary explosive composition may account for from approximately 1 wt % of the total weight of the primer composition to approximately 10 wt % of the total weight of the primer composition. When the secondary explosive composition is present in the primer composition, an inert or non-energetic binder may also used, such as an acid resistant binder. For instance, the non-energetic binder may be resistant to phosphoric acids, which are generated as phosphorus oxides during combustion of the primer composition. The non-energetic binder may be a compound or a mixture of compounds that includes carbon, hydrogen, nitrogen, and oxygen. For the sake of example only, the non-energetic binder may be a polymer or rubber compound that is resistant to phosphoric acids, such as gum arabic, gum tragacanth, styrene-butadine, epoxy resin, isobutylene rubber, gum xanthan, gum turpentine, or combinations thereof.

Non-energetic binders that are not acid resistant may be used if the primer composition also includes a neutralizing agent that reacts with, or otherwise neutralizes, the phosphoric acids. Such non-energetic binders may include, but are not limited to, a polystyrene, a polyester, a polyvinyl alcohol, or combinations thereof. By way of non-limiting example, Laminac 4116, a thermoset polyester material having 40% styrene as a filler, which is commercially available from Ashland Inc. (Covington, Ky.), may be used. The neutralizing agent may be a basic compound, such as an amine, a carbonate, or a hydroxide. By way of non-limiting example, the neutralizing agent may be potassium carbonate, potassium bicarbonate, magnesium carbonate, magnesium bicarbonate, sodium carbonate, sodium bicarbonate, or combinations thereof. In addition, the metal oxide present in the stabilized, encapsulated red phosphorus may neutralize the phosphoric acids. If present, the non-energetic binder may account for from approximately 0.1 wt % of the total weight of the primer composition to approximately 20 wt % of the total weight of the primer composition. If present, the neutralizing agent may account for from approximately 0.1 wt % of the total weight of the primer composition to approximately 5 wt % of the total weight of the primer composition.

Alternatively, the secondary explosive composition and non-energetic binder, if present, may be replaced with an energetic binder including, but not limited to, poly(3-azidomethyl-3-methyloxetane) ("poly-AMMO"), poly(bis(3,3-azidomethyl)oxetane) ("poly BAMMO"), poly(3-nitratomethyl-3-methyloxetane) ("poly NIMMO"), glycidyl azide polymer ("GAP"), poly(nitraminomethyl-methyloxetane) ("poly-NAMMO"), copoly-BAMMO/NAMMO, copoly-BAMMO/AMMO, and combinations thereof.

The fuel, if present in the primer composition, may be a metal, such as an element classified as a hard, or Type A, cation and having an ionic charge to ionic radius (z/r) ratio of 4 or 8, as described in "An Earth Scientist's Periodic Table of the Elements and Their Ions," L. Bruce Railsback, *Geology*, 31(9):737-740 (2003), the disclosure of which is incorporated by reference herein in its entirety. The Type A cations have no outer-shell electrons. These elements include, but are not limited to, magnesium, zirconium, aluminum, silicon, titanium, tungsten, alloys thereof, or combinations thereof. As described in the above-mentioned reference, silicon is classified as a metal. In one embodiment, the fuel is titanium. In another embodiment, the fuel is silicon. In another embodiment, the fuel is tungsten. The metal may be capable of forming a metal oxide having an electron shell configuration that is diffusion limited, as described in "Mechanochemical Mechanism for Fast Reaction of Metastable Intermolecular Compositions Based on Dispersion of Liquid Metal," Levitas et al., *J. Appl. Phys.* 101, 083524-1 to 083524-20, (2007), the disclosure of which is incorporated by reference herein in its entirety. If present, the fuel may account for from approximately 1 wt % of the total weight of the primer composition to approximately 10 wt % of the total weight of the primer composition.

Additional elements having an ionic charge to ionic radius (z/r) ratio of 4 or 8 include beryllium, scandium, yttrium, hafnium, thorium, vanadium, molybdenum, uranium, or plutonium. These elements, alloys thereof, or combinations thereof may also be used as the fuel. However, their use in the primer composition is less desirable since these elements are heavy metals or are toxic.

The primer composition may include approximately stoichiometric amounts of the stabilized, encapsulated red phosphorus and the oxidizer such that, when ignited, the primer composition substantially burns to completion. In one embodiment, the primer composition includes an elemental ratio of 2 phosphorus atoms to 5 oxygen molecules. In other words, the phosphorus in the stabilized, encapsulated red phosphorus may be substantially oxidized. The oxygen used to oxidize the phosphorus, or to oxidize other components of the primer composition, may be provided by the oxidizer, with little or no atmospheric oxygen being used. Since the stabilized, encapsulated red phosphorus and the oxidizer are present in stoichiometric amounts, the primer composition, when ignited, is substantially free of smoke. When ignited, the primer composition also produces a higher heat of formation relative to a red phosphorus-based smoke composition, due to the stoichiometric amounts of the stabilized, encapsulated red phosphorus and the oxidizer. The primer composition has a high heat content such that when the primer composition is combusted, thermobaric or thermobaric-like effects may be produced. In addition, the primer composition produces a much faster mass reaction rate when ignited. As such, the secondary explosive composition, if present in the primer composition, may be readily ignited.

For the sake of example only, the primer composition may include from approximately 10 wt % to approximately 30 wt % of Red Phosphorus HB 801 (TP), from approximately 0 wt % to approximately 10 wt % of PETN, from approximately 40 wt % to approximately 85 wt % of potassium nitrate, from approximately 0 wt % to approximately 10 wt % of aluminum, and from approximately 0.2 wt % to approximately 1.0 wt % of gum tragacanth.

In one embodiment, the primer composition, when dry, includes approximately 25 wt % Red Phosphorus HB 801 (TP), 5 wt % PETN, 64.8 wt % potassium nitrate, 5 wt % aluminum, and 0.2 wt % gum tragacanth.

In one embodiment, the primer composition includes stabilized, encapsulated red phosphorus, the oxidizer, and the secondary explosive composition. In another embodiment, the primer composition includes stabilized, encapsulated red phosphorus, the oxidizer, and the energetic binder. In yet another embodiment, the primer composition includes stabilized, encapsulated red phosphorus, the oxidizer, the secondary explosive composition, and the non-energetic binder. The fuel may, optionally, be present, in any of these embodiments.

The primer composition may be produced by combining or otherwise mixing the stabilized, encapsulated red phosphorus with the oxidizer, the secondary explosive composition (if present), the energetic binder (if present), the non-energetic binder (if present), and the fuel (if present) with approximately 15% water (by total weight) to form a homogenous mixture. Adding the water may desensitize the mixture to impact, friction, and static electrical ignition. These ingredients may be mixed by conventional techniques, such as those used for producing lead styphnate primer compositions, which are not described in detail herein. The mixture may be dried, before use, to produce the primer composition. Drying of the mixture may be conducted by conventional techniques, which are not described in detail herein.

Once produced, the primer composition may be loaded into a percussion cap primer, which is then used in various types of ordnance, such as in a cartridge for small arms ammunition, grenade, mortar fuse, or detcord initiator. The primer composition may be used to initiate or prime a mortar round, rocket motor, illuminating flare, signaling flare, or ejection seat. For the sake of example only, the primer composition may be used in a small arms cartridge, such as in a centerfire gun cartridge or in a rimfire gun cartridge. The centerfire gun cartridge may be a Boxer primer, a Berdan primer, or a shot shell primer. The percussion cap may be loaded with the primer composition using conventional techniques, such as those used in lead styphnate compositions, which are not described in detail herein.

The main explosive composition used in the ordnance device may be selected by one of ordinary skill in the art and, therefore, is not discussed in detail herein. The main explosive composition may be any explosive composition that is less sensitive to impact than the primer composition, such as a propellant or other charge. By way of non-limiting example, the main explosive composition may be a classical explosive composition or a non-classical (or thermobaric) explosive composition. For instance, if the ordnance device is a gun cartridge, the main explosive composition may be gun powder. In a grenade, the primer composition may be used to ignite a delay charge. In many cases, such as in mortar rounds or medium artillery cartridges, the primer composition may be used to ignite a booster charge that includes black powder or boron/potassium nitrate with an organic binder.

Figure 2:
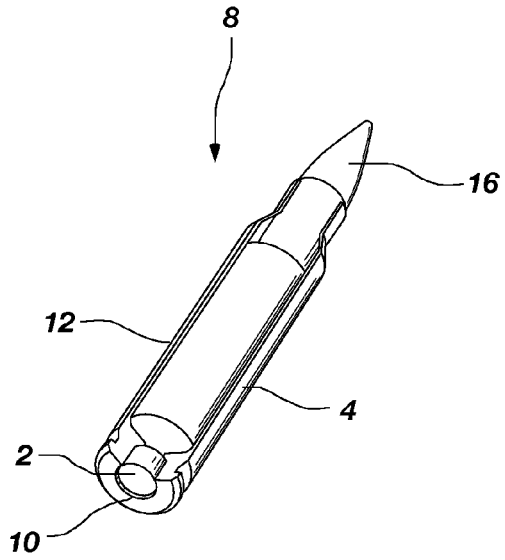
FIG. 2 is a cross-sectional view of a centerfire gun cartridge.

In one embodiment, the primer composition is used in a centerfire gun cartridge, a rimfire gun cartridge, or a shot shell. Rimfire ignition and centerfire ignition differ significantly from one another and, therefore, a primer composition that is suitable for use in the centerfire gun cartridge may not provide optimal performance in the rimfire gun cartridge. Centerfire ignition and shot shell differ slightly from each, since the shot shell configuration has a bar anvil and a battery cup. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the primer composition. Gun cartridges and cartridge casings are known in the art and, therefore, are not discussed in detail herein. The force or impact of the firing pin may produce an impact event or a percussive event that is sufficient to ignite the primer composition in the rimfire gun cartridge or in the centerfire gun cartridge, causing the main explosive composition to ignite or detonate. For instance, the impact of the firing pin may generate heat, flames, and hot particles, which ignite the main explosive composition, causing a detonation. As shown in FIG. 1, the primer composition 2 may be substantially evenly distributed around an interior volume defined by a rim portion 3 of a casing 4 of the rimfire gun cartridge 6. The primer composition 2 may be positioned in an aperture 10 in the casing 4, as shown in FIG. 2, which is a centerfire gun cartridge 8. The main explosive composition 12 may be positioned substantially adjacent to the primer composition 2 in the rimfire gun cartridge 6 or in the centerfire gun cartridge 8. When ignited or combusted, the primer composition 2 may produce sufficient heat and condensing hot particles to ignite the main explosive composition 12 to propel projectile 16 from the barrel of the firearm or larger caliber ordnance (such as, without limitation, handgun, rifle, automatic rifle, machine gun, automatic cannon, etc.) in which the cartridge 6 or 8 is disposed. The primer compositions 2 described above, when ignited, may produce a high heat content, which ignites the main explosive composition 12. However, as previously described, ignition of the primer composition 2 may produce minimal amounts of smoke.

Figure 3:
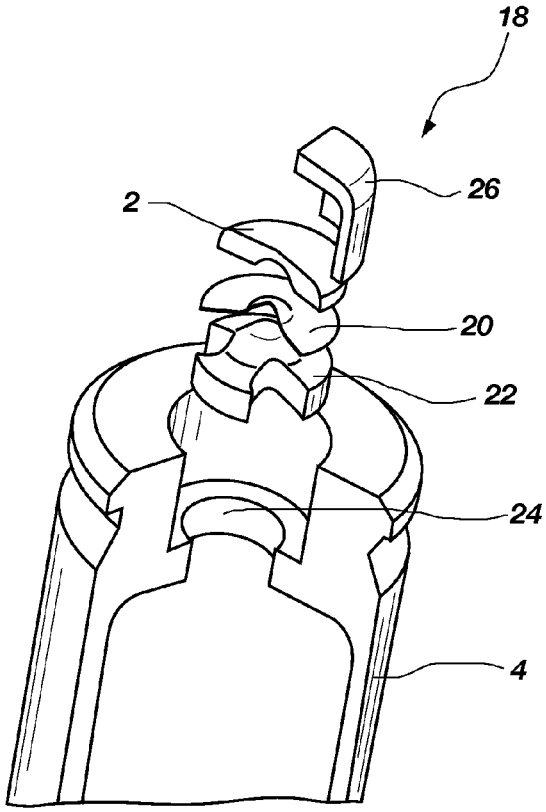
FIG. 3 is a cross-sectional view of a Boxer-type primer.
Figure 4:
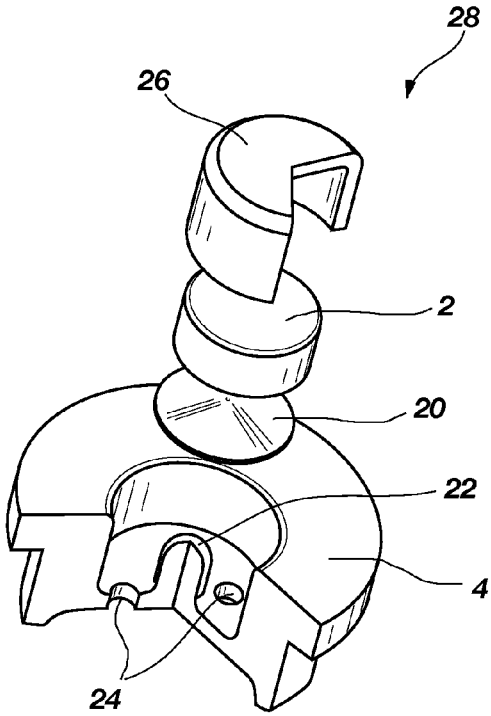
FIG. 4 is a cross-sectional view of a Berdan-type primer.
Figure 5:
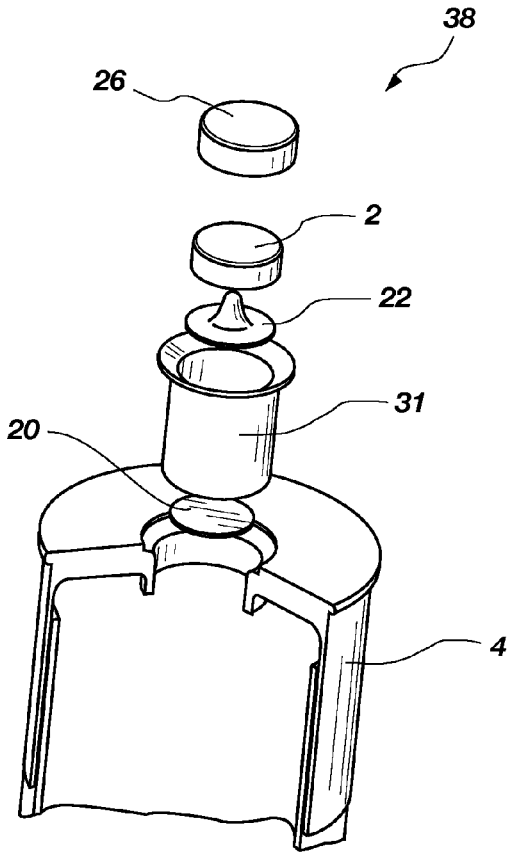
FIG. 5 is a cross-sectional view of a shot shell primer (Milbank type)

In another embodiment, the primer composition 2 may be used in a Boxer primer 18, as shown in FIG. 3. The Boxer primer 18 may include the primer composition 2 deposited in a primer cup or percussion cap 26. The Boxer primer 18 also includes a primer foil 20 in communication with the primer composition 2 and an anvil 22 pressed into the percussion cap 26. The percussion cap 26 may be positioned with a casing 4 such that at least a portion of the percussion cap 26 and the contents thereof may be positioned over a flash hole 24 in the center of the casing 4. In another embodiment, the primer composition 2 may be used in a Berdan primer 28, as shown in FIG. 4. The Berdan primer 28 may include the primer composition 2 deposited in a primer cup or percussion cap 26. A primer foil 20 may be placed between the primer composition 2 and an anvil 22 integrated with a casing 4. The percussion cap 26, with the primer composition 2 and primer foil 20 may be positioned over an anvil 22 in a casing 4 and over flash holes 24 in the casing 4. In another embodiment, the primer composition 2 may be used in a shot shell primer 38, as shown in FIG. 5. The shot shell primer 38 may include the primer composition 2 and an anvil 22 positioned in a battery cup 31 with a percussion cap 26 placed over the primer composition 2 in the battery cup 31. A primer foil 20 may be positioned between the battery cup 31 and a casing 4.

Figure 6:
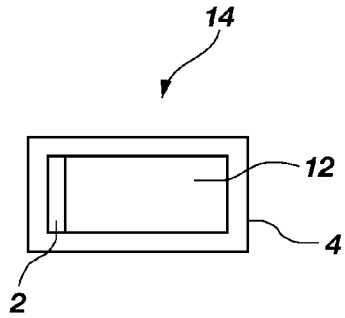
FIG. 6 is a schematic illustration of an exemplary ordnance device in which a primer composition of the present invention is used.

As previously mentioned, the percussion primer having the primer composition 2 may be used in larger ordnance, such as (without limitation) grenades, mortar rounds, mines and detcord initiators, or to initiate, rocket motors, illuminating and signal flares, as well as in ejection seats, tubular goods cutters, explosive bolts and other systems including another explosive composition or charge, alone or in combination with a propellant. In an ordnance device 14, the primer composition 2 may be positioned substantially adjacent to the main explosive composition 12 in a casing 4, as shown in FIG. 6. In the instance of an ordnance device 14 including a propellant (not shown), the main explosive composition 12 may typically be used to initiate the propellant.

Upon combustion, the primer composition may produce environmentally friendly or recyclable combustion products and by-products, which are absorbed by, or dispersed into, the biosphere or environment. Alternatively, the combustion products and by-products may be tolerated by the biosphere in high concentrations or may be dispersed quickly throughout the food chain. The combustion products and by-products include, but are not limited to, phosphorus oxides (such as PO, $PO_2$, $P_2O_3$, $P_2O_4$, or $P_2O_5$), metal phosphates, carbon dioxide, small amounts of phosphoric acids (such as $H_3PO_2$, $H_3PO_3$, or $H_3PO_4$), small amounts of $PH_3$, or mixtures thereof NASA Lewis Chemical Thermodynamic Code was used to model or predict the combustion products, which are shown in Table 1, at 1000 psi, 10,000 psi, and 50,000 psi.

TABLE 1

Predicted Chemical Species Produced upon Combustion.

| Chemical Species | 1,000 psi (%) | 10,000 psi (%) | 50,000 psi (%) |
|---|---|---|---|
| P | 0 | 0.001 | 0.001 |
| PH | 0 | 0 | 0 |
| $PH_3$ | 0 | 0 | 0 |
| PN | 0.009 | 0.167 | 0.268 |
| PO | 0.532 | 1.730 | 1.593 |
| $PO_2$ | 23.958 | 17.556 | 13.414 |
| $P_2$ | 0 | 0.001 | 0.004 |
| $P_4O_6$ | 36.256 | 37.856 | 41.060 |
| $P_4O_{10}$ | 0 | 0 | 0 |
| K | 17.657 | 9.361 | 5.702 |
| KCN | 0 | 0 | 0 |
| KH | 0.004 | 0.029 | 0.012 |
| KO | 2.018 | 1.350 | 1.649 |
| KOH | 13.576 | 12.767 | 3.483 |
| $K_2$ | 0.723 | 1.814 | 3.525 |
| KOH (L) | 0 | 0 | 9.544 |
| $K_2CO_3$ (L) | 5.267 | 17.368 | 19.745 |

Figure 7:
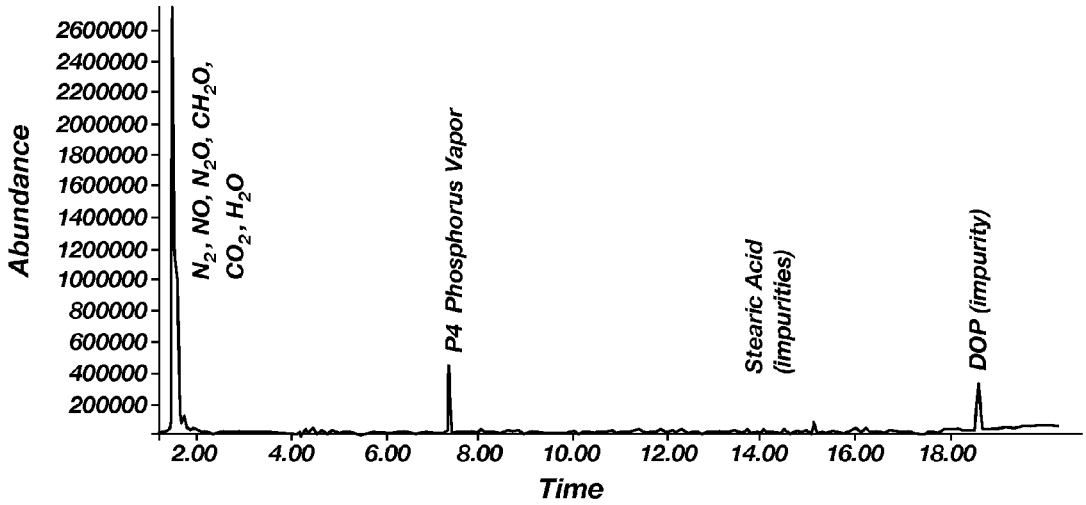
FIG. 7 is a total ion gas chromatogram from a closed bomb test using the primer composition of the present invention.

Closed bomb gas chromatograph analysis was used to confirm the presence of most of the chemical species predicted as combustion products, as shown in FIG. 7.

The phosphorus-based combustion products and by-products may react with $O_2$, $H_2O$, or combinations thereof in the biosphere to form phosphates, which are biodegradable. Phosphates are present in manure, soil, rocks, fertilizer, detergents, water, and plants and are more environmentally friendly than combustion products of conventional primer compositions, such as lead-based primer compositions. In addition, since elemental phosphorus is an essential mineral and is utilized in the Kreb's Cycle to convert pyruvate to carbon dioxide, the phosphorus-based combustion products and by-products produced from the primer composition are regulated by the body's biosynthesis mechanisms. In contrast, the combustion by-products of lead-based primer compositions are generally accumulated by the body's organs.

By stabilizing and encapsulating the red phosphorus and by including a binder (energetic or non-energetic) in the primer composition, the primer composition may generate reduced amounts of $PH_3$ and phosphoric acids during storage. This reduction in corrosive by-products enables the primer composition to be used in conventional, brass percussion cups. In addition, the primer composition may be more stable than conventional lead-based or lead-free primer compositions when exposed to $O_2$, $H_2O$, or combinations thereof at elevated temperatures. However, when combusted, the primer composition may achieve similar performance characteristics and properties as a conventional lead-based primer composition, a conventional lead-free primer composition, or a conventional phosphorous-based primer composition.

The stabilized, encapsulated red phosphorus in the primer composition may also prevent corrosion and wear of a barrel of the gun in which the primer composition is initiated. The small amount of phosphoric acids that is produced upon combustion of the stabilized, encapsulated red phosphorus may produce wear-resistant and corrosion-resistant compounds that deposit on a surface of the barrel. These compounds may provide a self-replenishing, protective layer on the barrel, improving the life of the barrel.

The following examples serve to explain embodiments of the primer composition in more detail. These examples are not to be construed as being exhaustive or exclusive as to the scope of this invention.

EXAMPLES

Example 1

Primer Composition Including Stabilized, Encapsulated Red Phosphorus

A primer composition having approximately 25 wt % Red Phosphorus HB 801 (TP), 5 wt % PETN, 64.8 wt % potassium nitrate, 5 wt % aluminum, and 0.2 wt % gum tragacanth was formulated by mixing the ingredients with from 7% to 15% water. The primer composition was mixed by conventional techniques. The primer composition is referred to herein as the "stabilized, encapsulated red phosphorus-based primer" and is indicated in the figures as "P4 Primer" or "RP."

Example 2

Stability of the Stabilized, Encapsulated Red Phosphorus-Based Primer

Stability of the primer composition described in Example 1 was tested by exposing the stabilized, encapsulated red phosphorus-based primer to a constant elevated temperature (approximately 50° C.) without humidity regulation. The stabilized, encapsulated red phosphorus-based primer was impact tested in accordance with Military Specification Mil P 44610 at all the fire heights. The stabilized, encapsulated red phosphorus-based primer was found to have a 0% misfire failure rate after approximately 180 days at the elevated temperature. In contrast, a lead styphnate-based primer known as Federal K75 had a 99% misfire failure rate after approximately 55 days at the same, elevated temperature.

Example 3

Impact Sensitivity of the Stabilized, Encapsulated Red Phosphorus-Based Primer Impact sensitivity of the primer composition described in Example 1 and the lead styphnate-based primer described in Example 2 were determined according to Military Specification Mil P 44610.

The stabilized, encapsulated red phosphorus-based primer had an average drop height of 6.7 inches (standard deviation of 1.2 inches) and the lead styphnate-based primer had an average drop height of 7.4 inches (standard deviation of 1.1 inches). Since the stabilized, encapsulated red phosphorus-based primer and the lead styphnate-based primer had statistically similar impact sensitivities, no change in configuration of the stabilized, encapsulated red phosphorus-based primer in a percussion cap was necessary.

Example 4

Performance of the Stabilized, Encapsulated Red Phosphorus-Based Primer

Figure 8:
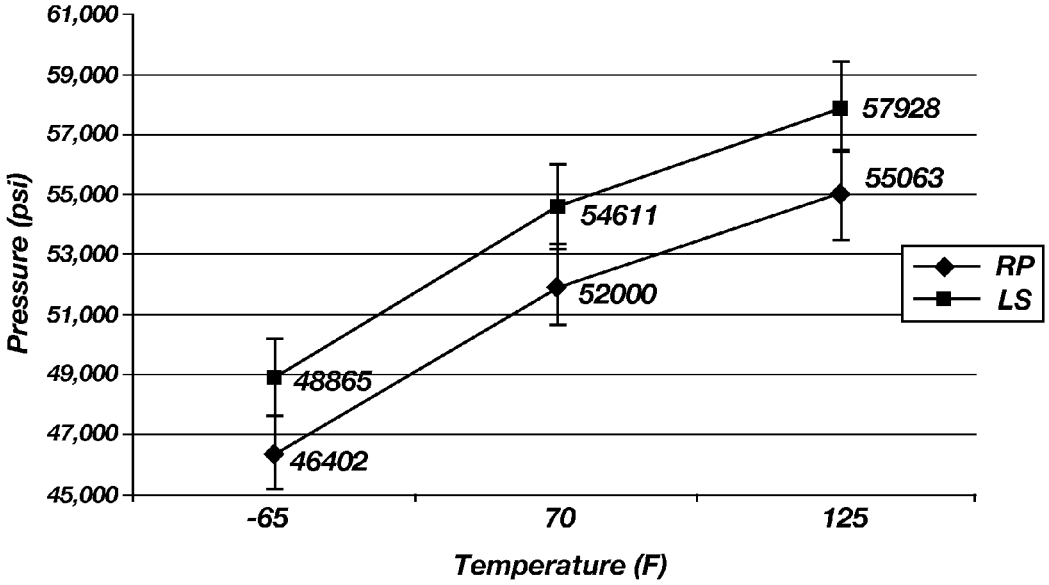
FIG. 8 shows the cartridge firing temperature versus gun chamber pressure of the primer composition of the present invention compared to that of a lead styphnate-based primer composition with a conventional propellant charge.
Figure 9:
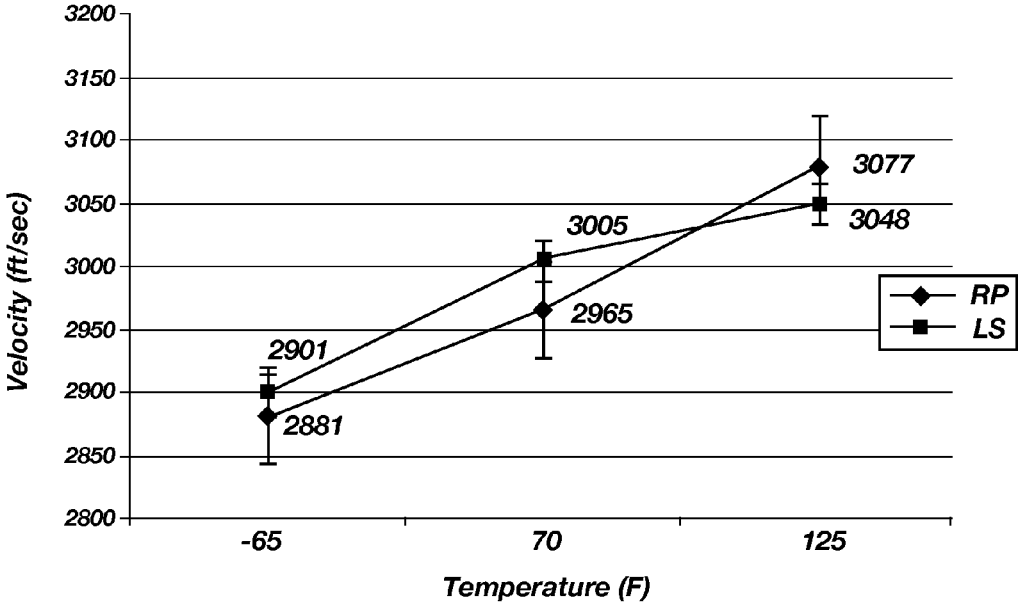
FIG. 9 shows the cartridge firing temperature versus muzzle velocity of the primer composition of the present invention compared to that of a lead styphnate-based primer composition with a conventional propellant charge.

The stabilized, encapsulated red phosphorus-based primer and the lead styphnate-based primer described above were loaded into conventional cartridges. The cartridge firing temperature versus propellant chamber pressure of the stabilized, encapsulated red phosphorus-based primer and the lead styphnate-based primer was determined for approximately 27 grain charge weight according to Government Specification Small Caliber Ammunition Test Procedure ("SCAT-P") 5.56 mm, Section 18. The lead styphnate-based primer is indicated in FIGS. 8 and 9 as "LS." As shown in FIG. 8, the firing temperature versus propellant chamber pressure of the cartridges including the stabilized, encapsulated red phosphorus-based primer was demonstrated to provide equal or less pressure at all firing temperatures, especially at cold temperatures. In contrast, cold temperature firing pressures using other non-toxic primer compositions have been shown to have undesirably high chamber pressures.

The cartridge firing temperature versus muzzle velocity of the stabilized, encapsulated red phosphorus-based primer and the lead styphnate-based primer in the conventional cartridge was determined according to SCAT-P, Section 20. As shown in FIG. 9, the firing temperature versus muzzle velocity of the stabilized, encapsulated red phosphorus-based primed cartridges was approximately equal to that of the lead styphnate-based primed cartridges. As shown by FIGS. 7-9 and Table 2, the stabilized, encapsulated red phosphorus-based primed cartridges and the lead styphnate-based primed cartridges had similar cartridge impact sensitivities, velocities, and pressures. Acceptable impact sensitivity limits may be determined by measuring height and voltage readings of a primer misfire and then comparing the H/V +/−3 S values, where H is a height measurement, V is a voltage measurement and S is the standard deviation of the test results multiplied by the interval of the tests. Acceptable impact sensitivities are indicated by H/V +3 S values of less than 12.0 and H/V −3 S values of greater than 3.0. The data in Table 2 indicate that acceptable impact sensitivities were obtained for embodiments of the invention.

TABLE 2

| | |
|---|---|
| Pi * m (m is the interval of the test) | 2.20 |
| H/V + (m/2) | 4.50 |
| H or V | 6.70 |
| H/V + (3) S | 10.3000 |
| H/V − (3) S | 3.1000 |

However, the stabilized, encapsulated red phosphorus-based primer had a greater long-term thermal stability than the lead styphnate-based primer.

Example 5

Primer Composition Including Stabilized, Encapsulated Red Phosphorus

A primer composition having approximately 25 wt % Red Phosphorus HB 801 (TP), 64.8 wt % potassium nitrate, 5 wt % PETN, 5 wt % magnesium, and 0.2 wt % gum tragacanth is formulated by mixing the ingredients with from 7% to 15% water. The primer composition is mixed by conventional techniques.

Example 6

Primer Composition Including Stabilized, Encapsulated Red Phosphorus

A primer composition having approximately 25 wt % Red Phosphorus HB 801 (TP), 64.8 wt % potassium nitrate, 5 wt % RDX, 5 wt % titanium, and 0.2 wt % gum tragacanth is formulated by mixing the ingredients with from 7% to 15% water. The primer composition is mixed by conventional techniques.

Example 7

Primer Composition Including Stabilized, Encapsulated Red Phosphorus

A primer composition having approximately 25 wt % Red Phosphorus HB 801 (TP), 64.8 wt % potassium nitrate, 5 wt % TNT, 5 wt % silicon, and 0.2 wt % gum tragacanth is formulated by mixing the ingredients with 15% water. The primer composition is mixed by conventional techniques.

Example 8

Primer Composition Including Stabilized, Encapsulated Red Phosphorus

A primer composition having approximately 25 wt % Red Phosphorus HB 801 (TP), 64.8 wt % potassium nitrate, 5 wt % CL-20, 5 wt % tungsten, and 0.2 wt % gum tragacanth is formulated by mixing the ingredients with 15% water. The primer composition is mixed by conventional techniques.

Example 9

Primer Composition Including Stabilized, Encapsulated Red Phosphorus

A primer composition having approximately 25 wt % Red Phosphorus HB 801 (TP), 64.8 wt % calcium nitrate, and 10.2 wt % magnesium is formulated by mixing the ingredients with from 7% to 15% water. The primer composition is mixed by conventional techniques.

Example 10

Primer Composition Including Stabilized, Encapsulated Red Phosphorus

A primer composition having approximately 25 wt % Red Phosphorus HB 801 (TP), 64.8 wt % strontium nitrate, and 10.2 wt % PETN is formulated by mixing the ingredients with from 7% to 15% water. The primer composition is mixed by conventional techniques.

Example 11

Primer Composition Including Stabilized, Encapsulated Red Phosphorus

A primer composition having approximately 25 wt % Red Phosphorus HB 801 (TP), 64.8 wt % calcium nitrate, and 10.2 wt % polyester is formulated by mixing the ingredients with from 7% to 15% water. The primer composition is mixed by conventional techniques.

Example 12

Primer Composition Including Stabilized, Encapsulated Red Phosphorus

A primer composition having approximately 25 wt % Red Phosphorus HB 801 (TP), 64.8 wt % sodium nitrate, 10 wt % PETN, and 0.2 wt % polystyrene is formulated by mixing the ingredients with from 7% to 15% water. The primer composition is mixed by conventional techniques.

Example 13

Primer Composition Including Stabilized, Encapsulated Red Phosphorus

A primer composition having approximately 25 wt % Red Phosphorus HB 801 (TP), 65 wt % calcium nitrate, 5 wt % magnesium, and 5 wt % PETN is formulated by mixing the ingredients with from 7% to 15% water. The primer composition is mixed by conventional techniques.

Example 14

Primer Composition Including Stabilized, Encapsulated Red Phosphorus

A primer composition having approximately 25 wt % Red Phosphorus HB 801 (TP), 65 wt % calcium nitrate, 10 wt % magnesium, and 0.2 wt % gum tragacanth is formulated by mixing the ingredients with from 7% to 15% water. The primer composition is mixed by conventional techniques.

Example 15

Primer Composition Including Stabilized, Encapsulated Red Phosphorus

A primer composition having approximately 25 wt % Red Phosphorus HB 801 (TP), 64.8 wt % potassium nitrate, 5 wt % aluminum, and 5.2 wt % poly-AMMO is formulated by mixing the ingredients with from 7% to 15% water. The primer composition is mixed by conventional techniques.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the invention as defined by the following appended claims and their legal equivalents.

What is claimed is:

1. A primer composition, comprising:

red phosphorus stabilized by an acid scavenger and a polymer; and at least one energetic binder comprising at least one of poly(3-azidomethyl-3-methyloxetane), poly(bis(3,3-azidomethyl)oxetane), poly(3-nitratomethyl-3-methyloxetane), glycidyl azide polymer, poly(nitraminomethyl-methyloxetane), copoly-(bis(3,3-azidomethyl) oxetane)/(nitraminomethyl-methyloxetane), copoly-(bis(3,3-azidomethyl)oxetane)/(3-azidomethyl-3-methyloxetane), and combinations thereof, wherein the primer composition is substantially free of lead.

2. A primer composition, comprising:

red phosphorus stabilized by an acid scavenger and a polymer;

at least one non-energetic binder selected from the group consisting of gum tragacanth, polyester, polystyrene, and combinations thereof;

a neutralizing agent comprising at least one of an amine, a carbonate, and a hydroxide; and at least one oxidizer.

3. The primer composition of claim 2, wherein the acid scavenger comprises a metal oxide, a hydrotalcite, a zeolite, a metal soap, or a metal carbonate.

4. The primer composition of claim 2, wherein the acid scavenger comprises a metal hydroxide selected from the group consisting of aluminum hydroxide, bismuth hydroxide, cadmium hydroxide, cerium hydroxide, germanium hydroxide, magnesium hydroxide, manganese hydroxide, silicon hydroxide, tin hydroxide, titanium hydroxide, zinc hydroxide, zirconium hydroxide, or combinations thereof.

5. The primer composition of claim 2, wherein the acid scavenger and the polymer substantially encapsulate the red phosphorus.

6. The primer composition of claim 2, wherein the acid scavenger and the polymer form a discontinuous coating on a surface of the red phosphorus.

7. The primer composition of claim 2, wherein the at least one oxidizer comprises a light metal nitrate of an alkali or alkali earth metal, the alkali or alkali earth metal having an atomic mass of less than or equal to approximately 133.

8. The primer composition of claim 7, wherein the at least one oxidizer comprises sodium nitrate, magnesium nitrate, potassium nitrate, calcium nitrate, strontium nitrate, or combinations thereof.

9. The primer composition of claim 2, wherein the at least one oxidizer comprises bismuth subnitrate.

10. A primer composition, comprising:

red phosphorus comprising a metal oxide and a polymer formed thereon;

at least one oxidizer selected from the group consisting of calcium nitrate, strontium nitrate, and sodium nitrate; and at least one of at least one secondary explosive composition and at least one energetic binder, wherein the primer composition is substantially free of lead.

11. The primer composition of claim 2, further comprising at least one secondary explosive composition selected from the group consisting of pentaerythritol tetranitrate, cyclo-1,3,5-trimethylene-2,4,6-trinitramine, cyclotetramethylene tetranitramine, trinitrotoluene, and combinations thereof.

12. The primer composition of claim 10, further comprising at least one non-energetic binder selected from the group consisting of gum arabic, gum tragacanth, gum xanthan, gum turpentine, polyester, polyurethane, polystyrene, styrene-butadine, epoxy resin, isobutylene rubber, and combinations thereof.

13. The primer composition of claim 2, wherein the neutralizing agent is selected from the group consisting of potassium carbonate, potassium bicarbonate, magnesium carbonate, magnesium bicarbonate, sodium carbonate, sodium bicarbonate, and combinations thereof.

14. The primer composition of claim 10, wherein the primer composition is substantially lead free.

15. The primer composition of claim 10, wherein the red phosphorus and the at least one oxidizer are present in the primer composition at approximately stoichiometric amounts.

16. The primer composition of claim 10, wherein the polymer comprises an epoxy resin, a melamine resin, a phenol formaldehyde resin, a polyurethane resin, or combinations thereof.

17. The primer composition of claim 10, further comprising at least one of beryllium, scandium, yttrium, hafnium, thorium, vanadium, molybdenum, uranium, plutonium, and alloys thereof.

18. The primer composition of claim 10, further comprising a fuel selected from the group consisting of magnesium, zirconium, aluminum, silicon, titanium, tungsten, alloys thereof, and combinations thereof.

19. The primer composition of claim 10, wherein the primer composition comprises an elemental ratio of two phosphorus atoms to five oxygen molecules.

20. The primer composition of claim 10, wherein the red phosphorus comprising a metal oxide and a polymer formed thereon comprises from approximately 10% by weight to approximately 30% by weight of a total weight of the primer composition, the at least one oxidizer comprises from approximately 30% by weight to approximately 80% by weight of the total weight of the primer composition, the at least one secondary explosive composition comprises from approximately 0% by weight to approximately 10% by weight of the total weight of the primer composition, and the at least one energetic binder comprises from approximately 0% by weight to approximately 20% by weight of the total weight of the primer composition.

21. The primer composition of claim 20, further comprising at least one fuel present at from approximately 1% by weight to approximately 10% by weight of the total weight of the primer composition.

22. A primer composition, consisting of:

red phosphorus coated with a metal oxide and a polymer;

potassium nitrate;

a metal material comprising at least one of magnesium, zirconium, aluminum, silicon, titanium, tungsten, and alloys thereof; and pentaerythritol tetranitrate and gum tragacanth.

23. The primer composition of claim 22, wherein the potassium nitrate and the red phosphorus coated with the metal oxide and the polymer are present in the primer composition at approximately stoichiometric amounts.

24. An ordnance element, comprising:

a primer composition comprising:

red phosphorus stabilized by an acid scavenger and a polymer; and at least one oxidizer; at least one energetic binder comprising at least one of poly(3-azidomethyl-3-methyloxetane), poly(bis(3,3-azidomethyl)oxetane), poly(3-nitratomethyl-3-methyloxetane), glycidyl azide polymer, poly(nitraminomethyl-methyloxetane), copoly-(bis(3,3-azidomethy)oxetane)/(nitraminomethyl-methyloxetane), copoly-(bis(3,3-azidomethyl)oxetane)/(3-azidomethyl-3-methyloxetane), and combinations thereof, wherein the primer composition is substantially free of lead; and at least one of another explosive and a propellant adjacent to the primer composition.

25. The ordnance element of claim 24, wherein the ordnance element is configured as one of a rimfire cartridge, a centerfire cartridge, a shot shell, a rifled slug shell, a grenade, a mortar round, a device including a detcord initiator, a rocket motor, an illuminating flare, a signaling flare, an aircraft ejection seat, a tubular goods cutter, and an explosive bolt.

* * * * *

UNITED STATES PATENT AND TRADEMARK OFFICE

CERTIFICATE OF CORRECTION

PATENT NO. : 8,540,828 B2
APPLICATION NO. : 12/194437
DATED : September 24, 2013
INVENTOR(S) : Randall T. Busky et al.

It is certified that error appears in the above-identified patent and that said Letters Patent is hereby corrected as shown below:

In the specification:

COLUMN 10, LINE 65, change "thereof NASA" to --thereof. NASA--

Signed and Sealed this
Sixth Day of May, 2014

Michelle K. Lee

Michelle K. Lee
*Deputy Director of the United States Patent and Trademark Office*